US008579667B2

(12) United States Patent
Serizawa et al.

(10) Patent No.: US 8,579,667 B2
(45) Date of Patent: Nov. 12, 2013

(54) ELECTRIC CONNECTION STRUCTURE

(75) Inventors: Kazufumi Serizawa, Kariya (JP); Jun Kondo, Nagoya (JP); Shu Kagami, Nagoya (JP)

(73) Assignee: Denso Corporation, Kariya (JP)

( * ) Notice: Subject to any disclaimer, the term of this patent is extended or adjusted under 35 U.S.C. 154(b) by 7 days.

(21) Appl. No.: 13/314,266

(22) Filed: Dec. 8, 2011

(65) Prior Publication Data

US 2012/0149256 A1 Jun. 14, 2012

(30) Foreign Application Priority Data

Dec. 8, 2010 (JP) ..... 2010-273572

(51) Int. Cl.
*H01R 9/24* (2006.01)

(52) U.S. Cl.
USPC ..... 439/884

(58) Field of Classification Search
USPC ..... 439/884, 70, 888, 931, 95
See application file for complete search history.

(56) References Cited

U.S. PATENT DOCUMENTS

| | | | | |
|---|---|---|---|---|
| 7,384,274 | B1 * | 6/2008 | Chen et al. | 439/74 |
| 7,465,171 | B2 * | 12/2008 | Miyazaki et al. | 439/74 |
| 7,476,108 | B2 * | 1/2009 | Swain et al. | 439/79 |
| 2010/0252002 | A1 * | 10/2010 | Fujino et al. | 123/472 |

FOREIGN PATENT DOCUMENTS

JP 2010-242574 10/2010

* cited by examiner

*Primary Examiner* — Jean F Duverne
(74) *Attorney, Agent, or Firm* — Nixon & Vanderhye P.C.

(57) ABSTRACT

An electric connection structure includes a plurality of strip-like first terminals and a plurality of second terminals welded to ends in a longitudinal direction of the first terminals. The first terminals are arranged in parallel with intervals therebetween. The first terminals are arranged so that at least a part thereof faces each other. The first terminals are arranged to be offset in the longitudinal direction alternately so that the ends of the first terminals in the longitudinal direction project. The second terminals are welded to the ends in the projected sides in the longitudinal direction in the first terminal.

7 Claims, 4 Drawing Sheets

ELECTRIC CONNECTION STRUCTURE

CROSS-REFERENCE TO RELATED APPLICATION

This application is based on and claims the benefit of priority from earlier Japanese Patent Application No. 2010-273572 filed Dec. 8, 2010, the description of which is incorporated herein by reference.

TECHNICAL FIELD

The present disclosure relates to an electric connection structure whose terminals are welded to each other.

BACKGROUND

Screw-fixing a pressure sensor, which detects a pressure of fuel injected into an internal-combustion engine, to a body of a fuel injector is proposed (refer to Japanese Patent Application Laid-Open Publication No. 2010-242574, for example).

With such a structure of screw-fixing the pressure sensor, a rotational position of the pressure sensor does not settle in a specific position when the screw-fixation is completed by rotating the pressure sensor.

Therefore, rotational positions of a plurality of sensor terminals disposed in the pressure sensor become random.

On the other hand, a connector attached to the body is required to be attached to a specific predetermined position among the body.

As a result, it becomes difficult to electrically connect a plurality of terminals (henceforth input/output terminals) of the connector disposed at the body and a plurality of sensor terminals where rotational positions are random.

In other words, it is difficult to screw-fix the pressure sensor in an exact position where the sensor terminals and the input/output terminals face each other at the time of completing the screw-fixation.

Additionally, it has been proposed to have a plurality of curved relay electrodes for relaying the sensor terminals and the input/output terminals are concentrically arranged around a center of rotation of the pressure sensor, and the pressure sensor is screw-fixed after welding the sensor terminals with the relay electrodes.

Moreover, the sensor terminals and the input/output terminals are electrically connected by welding the input/output terminals with the relay electrodes after arranging the strip-like input/output terminals in parallel and in a radial direction of the pressure sensor and screw-fitting the pressure sensor.

By the way, the inventors of the present disclosure examined abolishing of the connector of the conventional pressure sensor, and providing the pressure sensor having a composition of connecting lead wires to the input/output terminals through the relay terminals.

However, when the conventional pressure sensor is used as it is, each input/output terminal and each relay terminal are welded in the same side of all the input/output terminals.

Moreover, in order to secure a space required for welding the input/output terminals with the relay terminals, pitches between adjoining input/output terminals becomes large, and the problem occurs that the miniaturization of around the welding part cannot be performed.

SUMMARY OF THE DISCLOSURE

An embodiment provides an electric connection structure that can attain either expansion of a welding space or miniaturization of around a welding part circumference.

In an electric connection structure according to a first aspect, the electric connection structure includes a plurality of strip-like first terminals, and a plurality of second terminals welded to ends in a longitudinal direction of the first terminals.

The first terminals are arranged in parallel with intervals therebetween.

The first terminals are arranged so that at least a part thereof faces each other, the first terminals are arranged to be offset in the longitudinal direction alternately so that the ends of the first terminals in the longitudinal direction project, and the second terminals are welded to the ends in the projected sides in the longitudinal direction in the first terminal.

Accordingly, the welding parts are distributed to the both sides of the first terminals in the longitudinal direction.

As a result, if pitches between the first terminals are configured the same as those of the prior art, welding spaces can be obtained twice as much as those of the prior art.

On the other hand, if the welding spaces are configured the same as those of the prior art, the pitches between the first terminals becomes a half of those of the prior art, and the miniaturization of around the welding parts can be attained.

In the electric connection structure according to a second aspect, wherein, the first terminals are arranged in parallel and when a lining direction of the first terminals represents a direction of the first terminals perpendicular to the longitudinal direction of the first terminals, a width dimension represents a width of the second terminal at a welding part in the lining direction, and an inter-terminal gap size represents a size of a gap in the lining direction between the welding parts of the two first terminals among the first terminals, the width dimension is configured less than the inter-terminal gap size.

In the electric connection structure according to a third aspect, wherein, the first terminals and the second terminals are welded at parts where they overlap.

In the electric connection structure according to a fourth aspect, wherein, the first terminal and the second terminal are welded at a position where a tip of the second terminal contacts to the first terminal.

In the electric connection structure according to a fifth aspect, wherein, a convex part is disposed in a predetermined position in the longitudinal direction of the first terminal excluding the ends, and the convex part is connected to an electrode.

In the electric connection structure according to a sixth aspect, wherein, the first terminal is resin-molded to the first terminal member formed by resin, and the second terminal is resin-molded to the second terminal member formed by resin.

In the electric connection structure according to a seventh aspect, wherein, a fuel injector picks up a signal of a pressure sensor that detects a pressure of fuel injected using the electric connection structure.

DETAILED DESCRIPTION OF THE PREFERRED EMBODIMENTS

Figure 1:
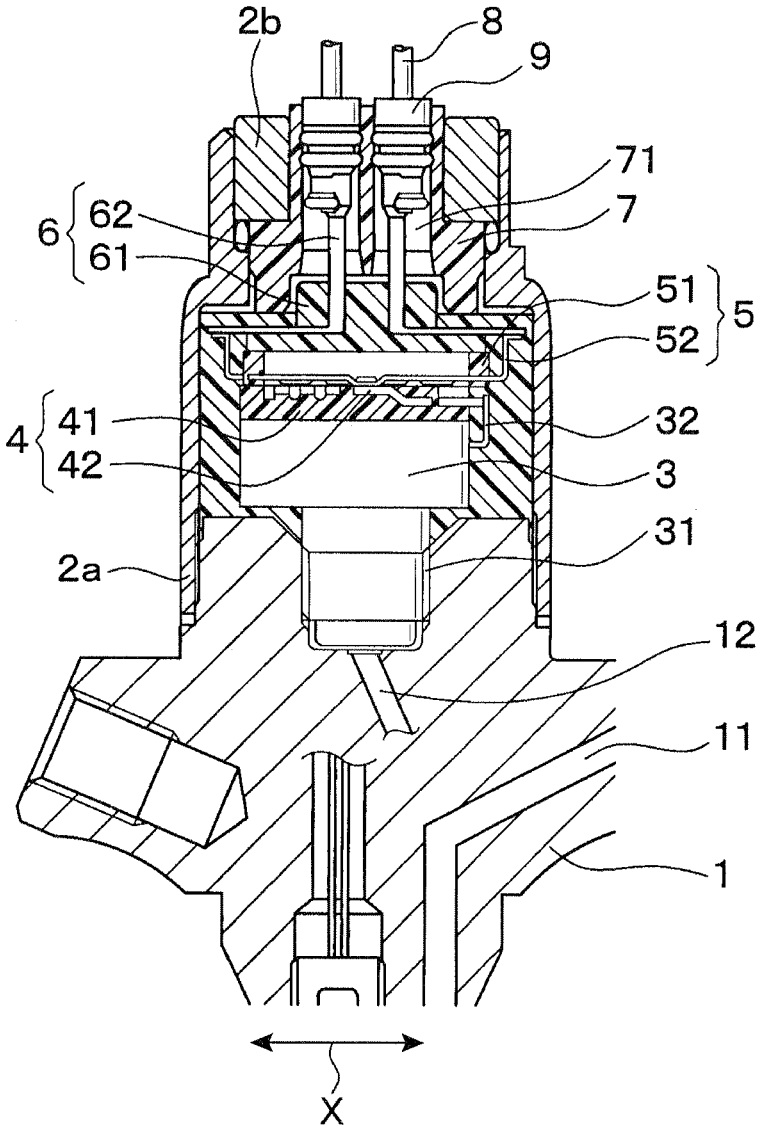
FIG. 1 shows a front sectional view of a principal part of an injector to which an electric connection structure of a first embodiment of the present disclosure is applied.
Figure 2A:
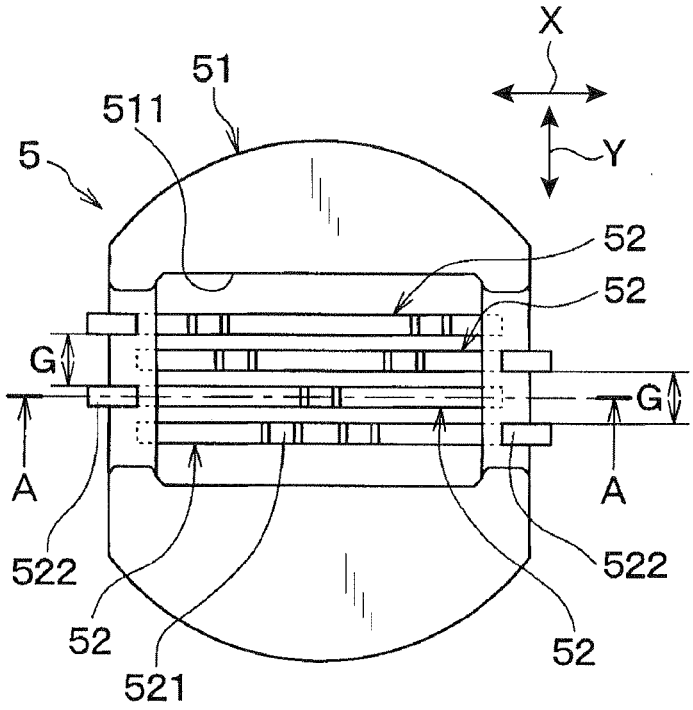
FIG. 2A shows a plan view of a first terminal member of FIG. 1.
Figure 2B:
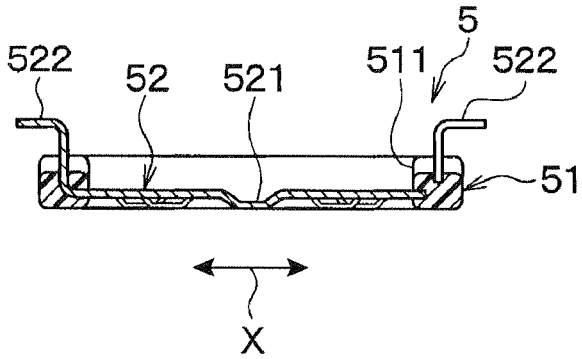
FIG. 2B shows a sectional view taken along a line A-A of FIG. 2A.

With reference to the drawings, hereinafter will be described embodiments of the present disclosure.

It should be appreciated that, in the following embodiments, the components identical with or similar maturely are given the same reference numerals for the sake of omitting explanation.

(The First Embodiment)

With reference to the drawings, hereinafter will be described an embodiment of the present disclosure. A term "intermediate part" used in the following description refers to all the portions except the both ends of a component.

As shown in FIG. 1, an injector injects high-pressure fuel supplied from a common-rail (not shown) into a cylinder of a diesel internal-combustion engine. A high-pressure fuel passage 11 where the high-pressure fuel flows is formed in an injector body 1.

A cylindrical first shield cover 2*a* is screwed to an end of the injector body 1. A disk-like second shield cover 2*b* is press-fixed at an opening end of the first shield cover 2*a*.

In addition, the injector body 1, the first shield cover 2*a*, and the second shield cover 2*b* are formed by a metal that is abundant in electromagnetic shielding nature, in order to cut off electrical noise.

A pressure sensor 5, a relay member 4, a first terminal member 5, a second terminal member 6 and an insulating member 7 are stacked in an axial direction of the injector and disposed in a space surrounded by the injector body 1, the first shield cover 2, and the second shield cover 3.

The pressure sensor 5 detects the fuel pressure of the high-pressure fuel passage 11. The relay member 4 has a plurality of relay electrodes. The first terminal member 5 has a plurality of first terminals. The second terminal member 6 has a plurality of second terminals. The insulating member 7 is made of resin, and is abundant in electric insulation nature.

The sensor chip has a male screw part 31, a plurality of sensor terminals 32 as electronic components, a sensor chip (not shown), an IC (not shown) for signal-processing circuits and the like.

The male screw part 31 is for screwing the pressure sensor 3 into the injector body 1. The sensor terminals 32 are made of conductive metals. The sensor chip changes a resistance value according to a pressure of the fuel led through a branch passage 12 branched from the high-pressure fuel passage 11.

The IC for signal-processing circuits outputs a sensor signal according to the pressure of the fuel based on the resistance value change of the sensor chip.

Further, the IC for signal-processing circuits is electrically connected with a plurality of lead wires 8 through the sensor terminals 32, the relay member 4, the first terminal member 5, and the second terminal member 6.

The lead wires 8 are used for supplying power to the IC for signal-processing circuits, for grounding, and for a sensor signal output that outputs the sensor signal to an ECU for engine control, etc.

Figure 3:
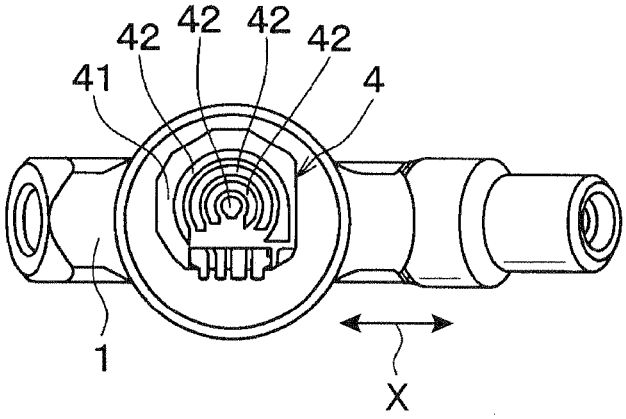
FIG. 3 shows a plan view of the injector in a state before attaching the first terminal member thereto.
Figure 4:
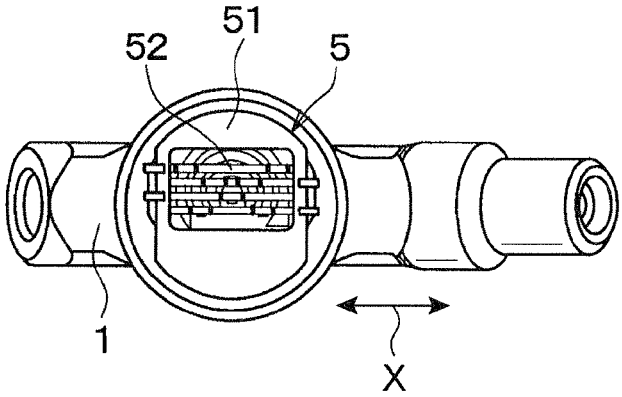
FIG. 4 shows a plan view of the injector in a state after attaching the first terminal member thereto.

As shown in FIG. 1 and FIG. 3, the relay member 4 with a tabular shape has a mold resin layer 41 made of mold resin. The relay member 4 is unified by molding the four relay electrodes 42 made of conductive metals together with the mold resin layer 41.

Each end part of the four relay electrodes 42 is projected from an outer circumferential surface of the mold resin layer 41, and the end parts are welded with the sensor terminals 32 of the pressure sensor 3.

The three relay electrodes 42 among the four have curved intermediate parts disposed concentrically around a center of rotation of the pressure sensor 3, and the curved intermediate parts are exposed to an upper side of the mold resin layer 41.

The one relay electrode 41 among the four has a substantially rectangular intermediate part disposed concentrically in the center of rotation of the pressure sensor 3, and the rectangular intermediate part is exposed to one end side of the mold resin layer 41.

As shown in FIG. 1, FIG. 2A, FIG. 2B and FIG. 4, the first terminal member 5 has a mold resin layer 51 made of mold resin. The first terminal member 5 is unified by molding the four first terminals 52 made of conductive metals.

The mold resin layer 51 has a tabular shape and a rectangular opening 511 is formed in a central part thereof.

The four first terminals 52 have strip-like shape formed by pressing long and narrow thin plates. The intermediate parts of the first terminals 52 in a longitudinal direction X (a direction perpendicular to the axial direction of the injector in the present embodiment) are disposed in the opening 511.

Convex parts 521 projecting towards the curved intermediate parts or the substantially rectangular intermediate part in the relay electrodes 42 are formed in the intermediate parts of the first terminals 52.

The convex parts 521 are welded with the intermediate parts of the relay electrode 42 facing each other.

Moreover, one end in the longitudinal direction X of each first terminal 52 is projected from the mold resin layer 51.

The four first terminals 52 are arranged in parallel while positions in the longitudinal direction X are shifted alternately.

In other words, the four first terminals 52 are arranged in staggered manner.

By this, one end in the longitudinal direction X of one of the first terminals 52 projects in the longitudinal direction X rather than an adjoining first terminal 52.

Ends in the projected sides in the longitudinal direction X are hereafter called projected ends 522.

The intermediate parts of the first terminals 52 are planar and perpendicular to the axial direction of the injector.

One end part of the first terminal 52 is bent in a direction parallel to the axial direction of the injector, then bent substantially 90 degrees again to form the projected end 522 in the first terminal 52.

Therefore, the projected ends 522 are planes perpendicular to the axial direction of the injector.

As shown in FIG. 1, the second terminal member 6 has a mold resin layer 61 made of mold resin. The second terminal member 6 is unified by molding the four second terminals 62 made of conductive metals.

The second terminals 62 are formed in an L-shape, and both ends project from the mold resin layer 61.

The one ends of the second terminals 62 face the projected ends 522 of the first terminals 52 and have planes perpendicular to the axial direction of the injector, and are welded with the projected ends 522 of the first terminals 52.

More specifically, the first terminals 52 and the second terminals 62 are welded by the parts where planes are overlapped in the axial direction of the injector.

Moreover, the other ends of the second terminals 62 are extended in the axial direction of the injector, and are electrically connected with the lead wires 8.

Here, the first terminals 52 are arranged in parallel. A lining direction of the first terminals 52 perpendicular to the longitudinal direction of the first terminals 52 is represented by Y (refer to FIG. 2).

In addition, a width dimension of the first terminal 52 at a welding part (mentioned later) to the second terminal 62 in the lining direction Y is represented by W (not shown).

Further, when a size of an inter-terminal gap in the lining direction Y between the projected ends 522 (namely, welding part) of the two first terminals 52 disposed in both sides among the three adjoining first terminals 52 is represented by G (refer to FIG. 2), the width dimension W is less than the inter-terminal gap size G.

A plurality of (four in the present embodiment) through holes 71 where the second terminals 62, the lead wires 8, and sealing members 9 are inserted is formed in parallel in the insulating member 7.

The sealing members 9 are cylindrical rubber members, and while the lead wires 8 are inserted inside, outer circumferential surfaces are in contact with the through holes 71.

Next, attaching procedure of the pressure sensor 3 etc. to the injector body 1 is explained.

First, a sensor subassembly is prepared. Specifically, the sensor subassembly is constituted by laying the relay member 4 on top of the pressure sensor 3 and unifying the pressure sensor 3 and the relay member 4 by welding the sensor terminals 32 and the relay electrodes 42.

Moreover, a lead wire subassembly is prepared. Specifically, the second terminal member 6, the lead wires 8 and the sealing members 9 are unified, and the second shield cover 2*b* and the insulating member 7 are unified.

Then, the lead wire subassembly is constituted by passing the lead wires 8 through the first shield cover 2*a*, and then through the through hole 71 of the insulating member 7.

Next, the sensor subassembly is attached to the injector body 1 by screwing the male screw part 31 of the pressure sensor 3 into the injector body 1.

Then, the first terminal member 5 is laid on the relay member 4 of the sensor subassembly, and the relay electrodes 42 and the first terminals 52 are welded.

Then, the second terminal member 6 of the lead subassembly is laid on the first terminal 52, and the first terminals 52 and the second terminals 62 are welded.

Here, the welding parts of the first terminals 52 and the second terminals 62 are distributed to the both sides (left and right in the figure) of the longitudinal direction X.

As a result, if pitches between the first terminals 52 are configured the same as those of the prior art, welding spaces can be obtained twice as much as those of the prior art.

On the other hand, if the welding spaces are configured the same as those of the prior art, the pitches between the first terminals 52 becomes a half of those of the prior art, and the miniaturization of around the welding parts can be attained.

Moreover, the width dimension W of the second terminal 62 is less than the inter-terminal gap size G of the first terminal 52.

As a result, when welding the first terminals 52 and the second terminals 62, the second terminals 62 do not contact the two first terminals 52 even if the lining direction Y position of the second terminal 62 to the first terminal 52 shifts from a reference position.

Then, the sensor subassembly, the first terminal member 5, and the lead subassembly are secondarily formed by resin in the state where these components are attached to the injector body 1.

Then, the first shield cover 2*a* is attached to the injector body 1 by screwing the first shield cover 2*a* to the injector body 1.

Then, the second shield cover 2*b* and the insulating member 7 are attached to the first shield cover 2*a* by press-fitting the insulating member 7 into the first shield cover 2*a*, while the sealing members 9 are inserted into the through holes 71 of the insulating member 7.

By this, assembling of the pressure sensor 3 etc. to the injector body 1 is completed.

According to the present embodiment, the welding parts of the first terminals 52 and the second terminals 62 are distributed to the both sides of the longitudinal direction X.

As a result, an increase in the space of the welding parts of the first terminals 52 and the second terminals 62, or the miniaturization of around the welding parts can be attained.

Moreover, the width dimension W of the second terminal 62 is less than the inter-terminal gap size G of the first terminal 52.

As a result, the second terminals 62 can be prevented from contacting the two first terminals 52.

(The Second Embodiment)

The second embodiment of the present disclosure is explained.

The present (second) embodiment changes the composition of the welding parts of the first terminals 52 and the second terminals 62, and since the rest is the same as that of the first embodiment, only a different port is explained here.

Figure 5:
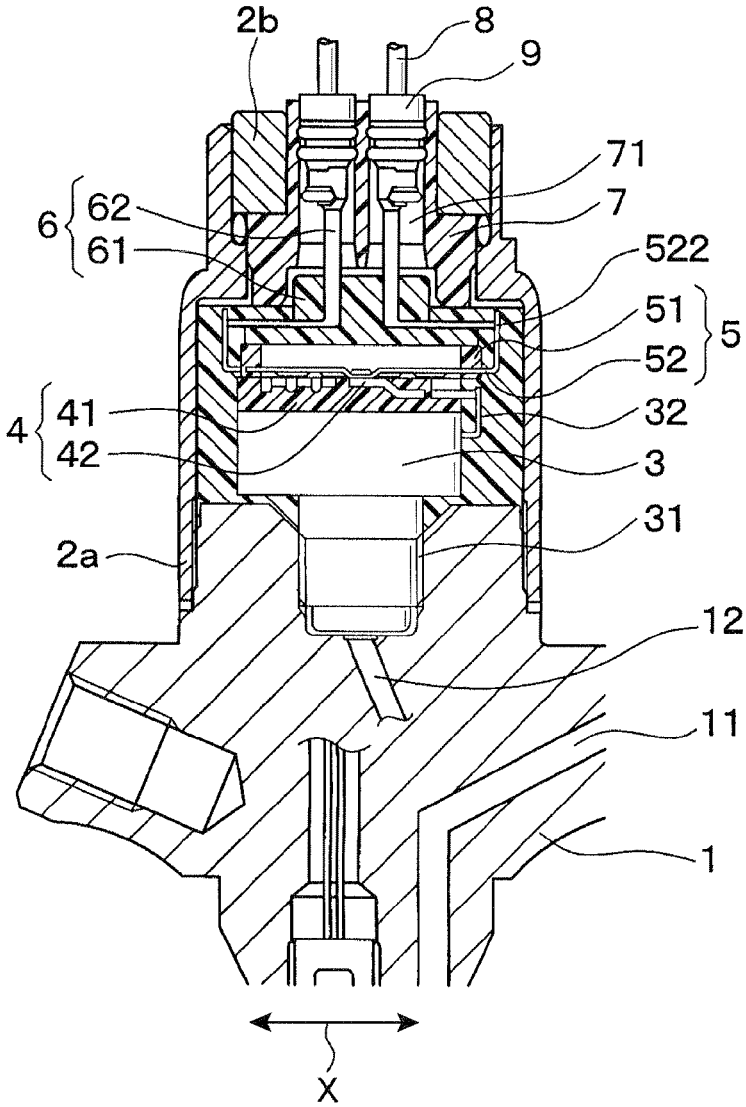
FIG. 5 shows a front sectional view of a principal part of the injector to which the electric connection structure of a second embodiment of the present disclosure is applied.
Figure 6A:
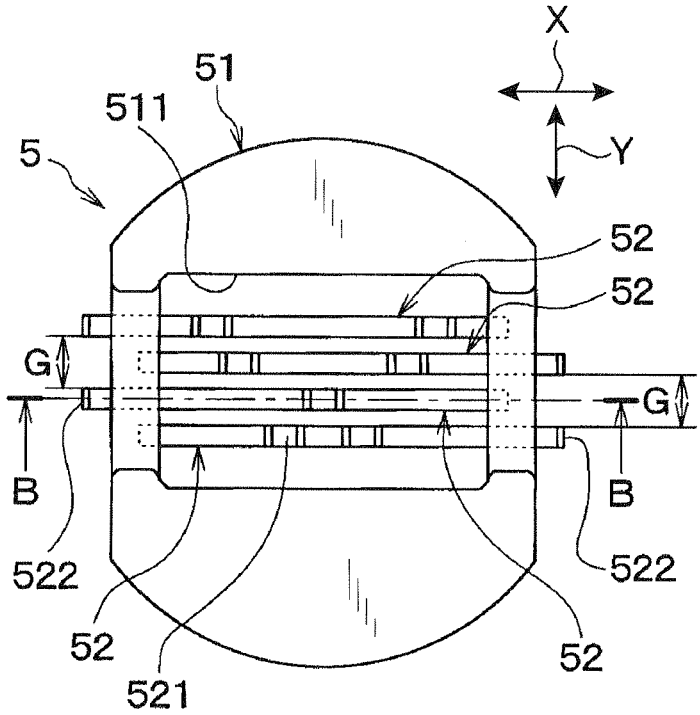
FIG. 6A shows a plan view of the first terminal member of FIG. 5.
Figure 6B:
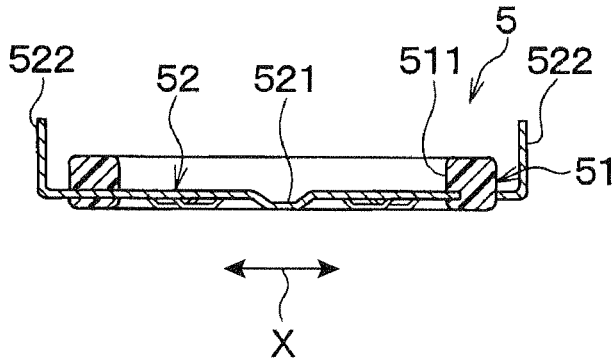
FIG. 6B shows a sectional view taken along a line B-B of FIG. 6A.

As shown in FIG. 5 and FIG. 6, the projected ends 522 of the first terminals 52 are extended in parallel in the axial direction of the injector.

The tips of the one ends of the second terminals 62 are configured to contact to the projected ends 522 of the first terminals 52, and the first terminals 52 and the second terminals 62 are welded at the contacted positions.

(Other Embodiments)

Although the present disclosure is applied to the injector in the embodiments mentioned above, the present disclosure is applicable to other than the injector, such as a gas passage, etc.

What is claimed is:

1. An electric connection structure comprising:

a plurality of strip-like first terminals having first ends and second ends in a longitudinal direction of the first terminals; and a plurality of second terminals welded to one of the first ends and the second ends in the longitudinal direction of the first terminals, wherein, the first terminals are arranged in parallel with intervals therebetween, the first terminals are arranged so that at least a part thereof faces each other, the first terminals are arranged to be offset in the longitudinal direction alternately between the first terminals next to each other, and the second terminals are welded to the ends in the projected sides in the longitudinal direction among the first ends and the second ends in the first terminals.

2. The electric connection structure according to claim 1, wherein, the first terminals are arranged in parallel and when a lining direction of the first terminals represents a direction of the first terminals perpendicular to the longitudinal direction of the first terminals, a width dimension represents a width of the second terminal at a welding part in the lining direction, and an inter-terminal gap size represents a size of a gap in the lining direction between the welding parts of the two first terminals among the first terminals, the width dimension is configured less than the inter-terminal gap size.

3. The electric connection structure according to claim 1, wherein, the first terminals and the second terminals are welded at parts where they overlap.

4. The electric connection structure according to claim 1, wherein, the first terminal and the second terminal are welded at a position where a tip of the second terminal contacts to the first terminal.

5. The electric connection structure according to claim 1, wherein, a convex part is disposed in a predetermined position in the longitudinal direction of the first terminal excluding the ends, and the convex part is connected to an electrode.

6. The electric connection structure according to claim 1, wherein, the first terminal is resin-molded to the first terminal member formed by resin, and the second terminal is resin-molded to the second terminal member formed by resin.

7. The electric connection structure according to claim 1, wherein, a fuel injector picks up a signal of a pressure sensor that detects a pressure of fuel injected using the electric connection structure.

* * * * *